US009441317B1

(12) United States Patent
Lee

(10) Patent No.: US 9,441,317 B1
(45) Date of Patent: Sep. 13, 2016

(54) YARN CLIPPING AND CUTTING STRUCTURE FOR STRIPING APPARATUS OF CIRCULAR KNITTING MACHINE

(71) Applicant: PAI LUNG MACHINERY MILL CO., LTD., New Taipei (TW)

(72) Inventor: Peng Cheng Lee, New Taipei (TW)

(73) Assignee: PAI LUNG MACHINERY MILL CO., LTD., New Taipei (TW)

( * ) Notice: Subject to any disclaimer, the term of this patent is extended or adjusted under 35 U.S.C. 154(b) by 0 days.

(21) Appl. No.: 14/731,204

(22) Filed: Jun. 4, 2015

(51) Int. Cl.
*D04B 15/60* (2006.01)

(52) U.S. Cl.
CPC ..... *D04B 15/60* (2013.01)

(58) Field of Classification Search
CPC ..... D04B 15/58; D04B 15/60; D04B 15/61; D04B 15/62
USPC ..... 66/133–135, 138, 139, 140 R, 140 S, 66/141–144
See application file for complete search history.

(56) References Cited

U.S. PATENT DOCUMENTS 4,656,842 A * 4/1987 Sawazaki ..... D04B 15/60 66/139
5,070,709 A 12/1991 Güell
5,218,845 A 6/1993 Wang
6,000,245 A * 12/1999 Plath ..... D04B 15/60 66/139
6,058,742 A * 5/2000 Dalmau Guell ..... D04B 15/60 66/140 R
6,408,655 B1 * 6/2002 Ossensi ..... D04B 15/94 66/140 R
6,655,176 B1 12/2003 Wang
7,036,343 B1 5/2006 Wei
7,690,224 B1 * 4/2010 Wei ..... D04B 15/60 66/140 R
7,845,196 B1 * 12/2010 Pai ..... D04B 15/61 66/133
7,861,559 B2 * 1/2011 Lonati ..... D04B 15/60 66/140 R
8,000,830 B1 * 8/2011 Chao ..... D04B 1/126 66/138

* cited by examiner

*Primary Examiner* — Danny Worrell
(74) *Attorney, Agent, or Firm* — Muncy, Geissler, Olds & Lowe, P.C.

(57) ABSTRACT

A yarn clipping and cutting structure for a striping apparatus of a circular knitting machine, including two yarn clipping and cutting drive blades that abut each other and can be driven synchronously. A first yarn clipping and cutting drive blade is bordered by a yarn feeding blade. The first yarn clipping and cutting drive blade and the yarn feeding blade are interposed by a yarn clipping blade. The first yarn clipping and cutting drive blade has a first end edge formed a first yarn picking portion which has a directing section. A second yarn clipping and cutting drive blade has another side opposing the yarn clipping blade with a yarn cutting blade. The second yarn clipping and cutting drive blade has a second end edge formed a second yarn picking portion. The second yarn picking portion has a spaced section to form an elevation difference against the directing section.

12 Claims, 10 Drawing Sheets

YARN CLIPPING AND CUTTING STRUCTURE FOR STRIPING APPARATUS OF CIRCULAR KNITTING MACHINE

FIELD OF THE INVENTION

The present invention relates to a striping apparatus of knitting machines and particularly to a striping apparatus for a circular knitting machine.

BACKGROUND OF THE INVENTION

Using striping apparatus on a circular knitting machine is a technique known in the art. The circular knitting machine that adopts the striping apparatus, depending on their functional and structural differences, will have changes on installation. Based on this perspective, the striping apparatus can generally be divided into vertical type and horizontal type. For instance, U.S. Pat. No. 6,655,176 entitled "Striping apparatus for a circular knitting machine" and No. 5,070,709 entitled "Striping system for circular knitting machine" disclose respectively a vertical striping apparatus to feed different colored yarns into a knitting machine, while U.S. Pat. No. 5,218,845 entitled "Circular knitting machine striper control system" and No. 7,036,343 entitled "Striping apparatus of a circular knitting machine" disclose respectively a horizontal striping apparatus and a controller used on a knitting machine.

However, either the vertical or horizontal striping apparatus in the prior techniques still have flaws on their yarn clipping and cutting structure, notably:

1. They have a yarn picking portion on a yarn clipping and cutting drive blade and a yarn clipping blade with respectively an edge angle formed thereon that is prone to rupture colored yarns during yarn clipping operation, and after a yarn cutoff operation is finished by a yarn cutting blade at another side a small section of yarn debris is formed that is subsequently released by the yarn picking portion and drops, and easily being carried to the knitting fabric with knitting operation, and could affect fabric quality.

2. Moreover, the conventional yarn clipping structure does not provide colored yarn buffer design. In the event that the colored yarn is ruptured during the yarn clipping operation yarn dropping caused by insecure yarn clipping frequently takes place in the high speed operation of the striping apparatus.

SUMMARY OF THE INVENTION

The primary object of the present invention is to solve the disadvantages and problems of the conventional techniques to make sure that colored yarns are securely clipped and cut off at merely one side to prevent yarn dropping or generation of yarn debris, and reduce product defects and enhance knitting operation stability of knitting needles.

Another object of the invention is to maintain the original thickness of yarn clipping and cutting mechanism of the striping apparatus to facilitate installation of the striping apparatus on the circular knitting machine that have a greater number of yarn feeding ports.

To achieve the foregoing objects the present invention provides a yarn clipping and cutting structure for a striping apparatus of a circular knitting machine that is installed on a circular knitting machine and driven by operation thereof. The striping apparatus includes a plurality of yarn clipping and cutting structures. Each yarn clipping and cutting structure has features as follow: it has two yarn clipping and cutting drive blades that abut each other and can be driven synchronously. A first yarn clipping and cutting drive blade has one side with a yarn feeding blade located thereon. The first yarn clipping and cutting drive blade and the yarn feeding blade are interposed by a yarn clipping blade in contact with the first yarn clipping and cutting drive blade. The first yarn clipping and cutting drive blade has a first end edge formed a first yarn picking portion. The yarn picking portion has a directing section movable against the yarn clipping blade to perform yarn clipping operation. A second yarn clipping and cutting drive blade has another side opposing the yarn clipping blade with a yarn cutting blade located thereon in contact with the second yarn clipping and cutting drive blade. The second yarn clipping and cutting drive blade has a second end edge formed a second yarn picking portion. The second yarn picking portion forms a yarn clipping movement against the yarn cutting blade and has a spaced section formed an elevation difference against the directing section.

In one aspect the directing section has a first directing sloped surface close to the yarn clipping blade.

In another aspect the directing section has a second directing sloped surface close to the spaced section.

In yet another aspect the yarn clipping and cutting structures are interposed by an isolation blade.

To achieve the foregoing objects the present invention further provides a yarn clipping and cutting structure for a striping apparatus of a circular knitting machine that is installed on a circular knitting machine and driven by operation thereof. The striping apparatus includes a plurality of yarn clipping and cutting structures. Each yarn clipping and cutting structure has features as follow: it has a yarn clipping and cutting drive blade with a yarn feeding blade at one side. The yarn clipping and cutting drive blade and the yarn feeding blade are interposed by a yarn clipping blade in contact with the yarn clipping and cutting drive blade. The yarn clipping and cutting drive blade has another side with a yarn cutting blade located thereon in contact with the yarn clipping and cutting drive blade. The yarn clipping and cutting drive blade has an end edge formed a yarn picking portion. The yarn picking portion has a directing section movable against the yarn clipping blade to perform yarn clipping operation, and a spaced section movable against the yarn cutting blade to perform the yarn clipping operation, and formed an elevation difference against the directing section.

In one aspect the directing section has a first directing sloped surface close to the yarn clipping blade.

In another aspect the directing section has a second directing sloped surface close to the spaced section.

In yet another aspect the yarn clipping and cutting structures are interposed by an isolation blade.

Through the techniques set forth above, compared with the convention techniques, the invention can achieve many advantageous effects, notably: 1. The yarn clipping and cutting drive blade of the invention can form a yarn clipping safety buffer section during yarn clipping and cutting process, hence can prevent colored yarns from dropping from the yarn clipping blade while the circular knitting machine is in high speed operation with the colored yarns being stretched. 2. With the first directing sloped surface formed between the directing section of the yarn picking portion and the yarn clipping blade and side angle cut off, rupturing of the colored yarn during the yarn clipping operation can be prevented. Moreover, After the colored yarn is clipped the yarn picking portion and the yarn cutting blade at another side perform yarn cutting operation, therefore the yarn is cut off only at one side, and can prevent generation of yarn debris and improve the quality of knitting fabrics.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
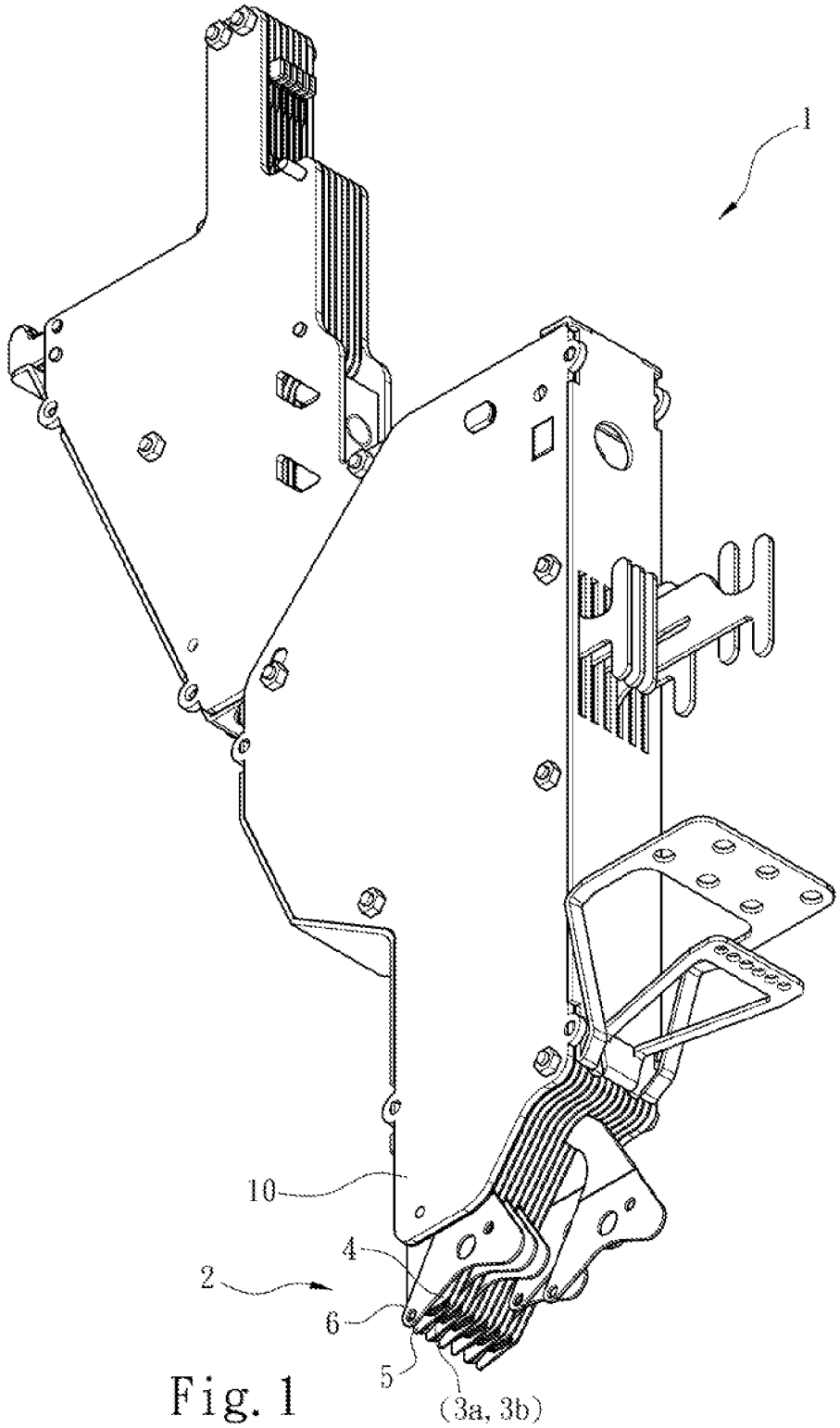
FIG. 1 is a perspective view of a first embodiment of the invention.
Figure 2:
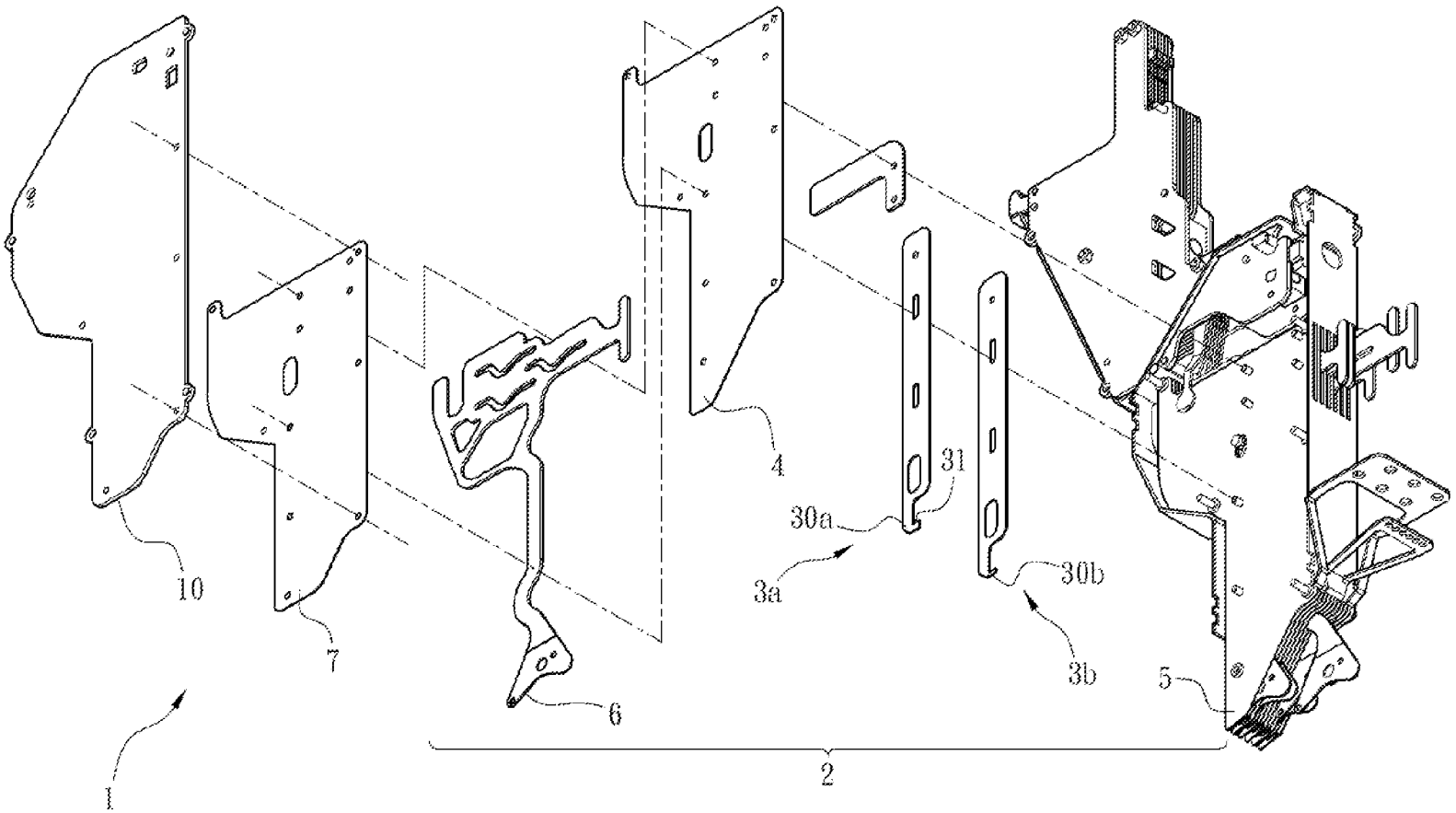
FIG. 2 is an explode view according to FIG. 1.
Figure 3:
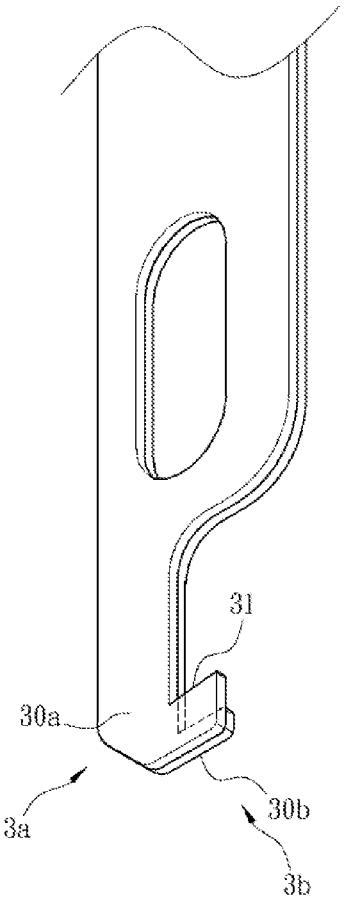
FIG. 3 is a fragmentary enlarged view of a yarn clipping and cutting drive blade according to FIG. 1.
Figure 4:
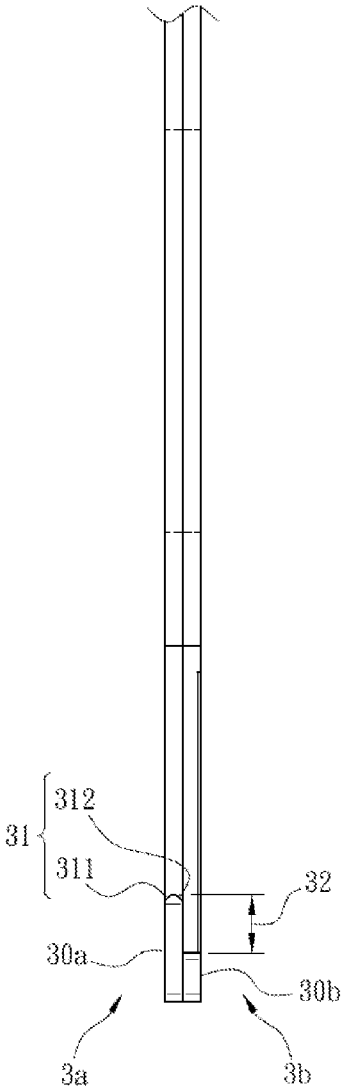
FIG. 4 is an enlarged top view according to FIG. 3.

Please refer to FIGS. 1 through 5 for a first embodiment of the invention. The invention provides a yarn clipping and cutting structure for a striping apparatus 1 (a vertical type in this embodiment) installed on a circular knitting machine (at a position which can be referred to the prior arts mentioned previously), and driven by operation of the circular knitting machine. The striping apparatus 1 has two sides each has an outer cover plate 10 located thereon, and a plurality of yarn clipping and cutting structures 2 located between the two outer cover plates 10. The yarn clipping and cutting structures 2 can be interposed by an isolation blade 7 between them (also can be omitted in this embodiment). Each yarn clipping and cutting structure 2 includes two yarn clipping and cutting drive blades that abut each other and are driven synchronously. A first yarn clipping and cutting drive blade 3*a* has one side with a yarn feeding blade 6 located thereon. The first yarn clipping and cutting drive blade 3*a* and the yarn feeding blade 6 are interposed by a yarn clipping blade 4 in contact with the first yarn clipping and cutting drive blade 3*a*. The first yarn clipping and cutting drive blade 3*a* has a first end edge formed a first yarn picking portion 30*a* which has a directing section 31 movable against the yarn clipping blade 4 to perform yarn clipping operation. The directing section 31 has a first directing sloped surface 311 close to the yarn clipping blade 4 to prevent a colored yarn 8 from being ruptured during the yarn clipping operation, and a second directing sloped surface 312 close to a spaced section 32 that also can prevent the colored yarn 8 from being ruptured during the yarn clipping operation. A second yarn clipping and cutting drive blade 3*b* has another side with a yarn cutting blade 5 located thereon in contact with the another second yarn clipping and cutting drive blade 3*b*. The second yarn clipping and cutting drive blade 3*b* has a second end edge formed a second yarn picking portion 30*b* which has the spaced section 32 formed thereon movable against the yarn cutting blade 5 and formed an elevation difference against the directing section 31.

Figure 5:
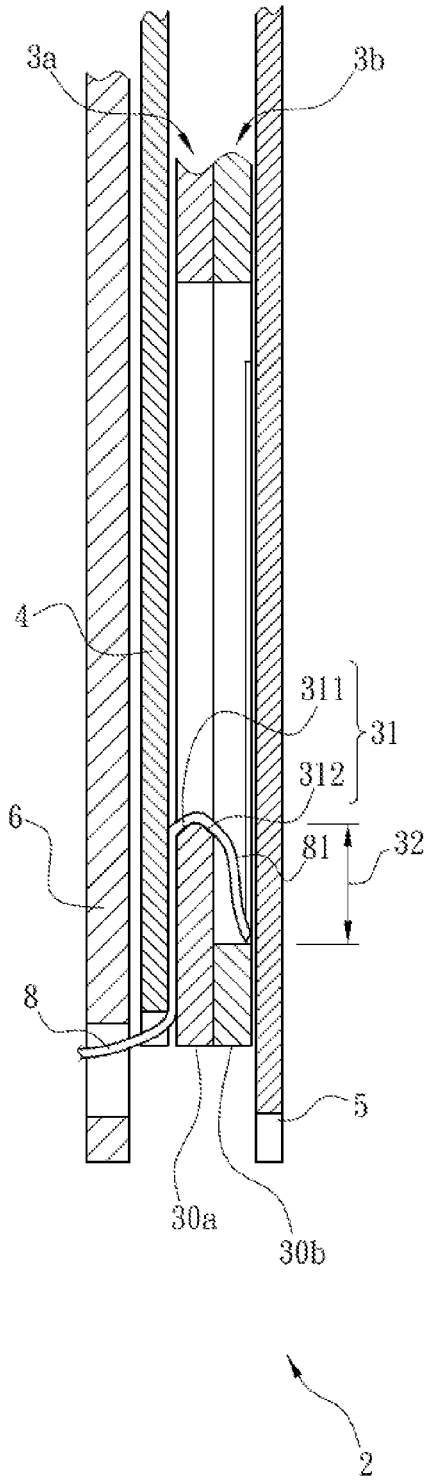
FIGS. 5 through 10 are fragmentary schematic views showing consecutive operating conditions of the yarn clipping and cutting structure according to FIG. 1.
Figure 6:
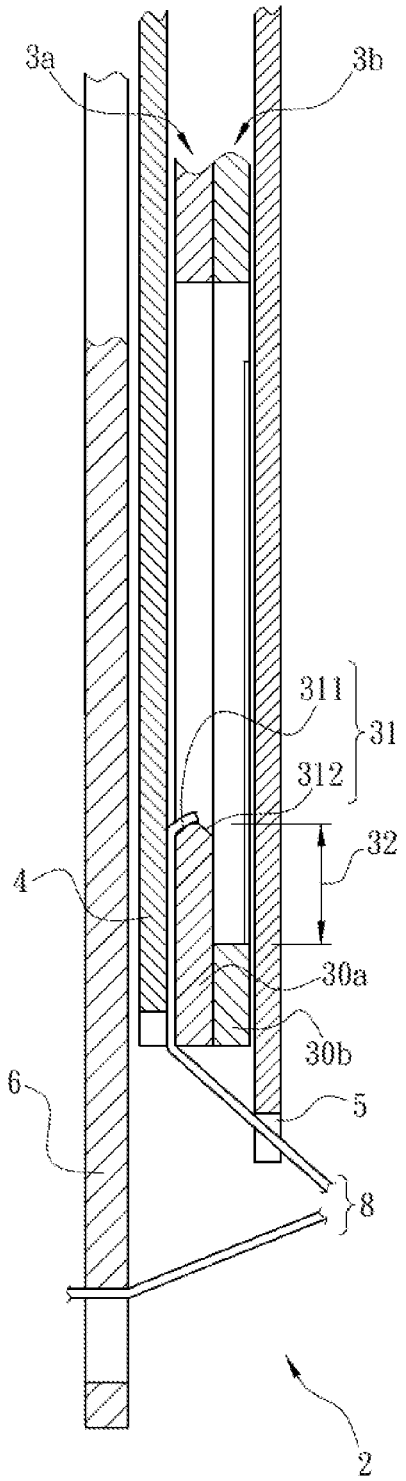
Figure 7:
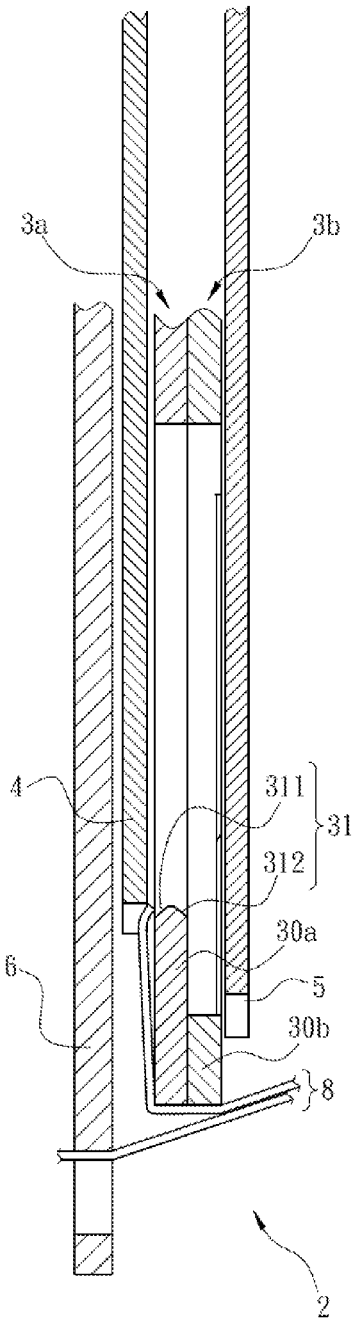
Figure 8:
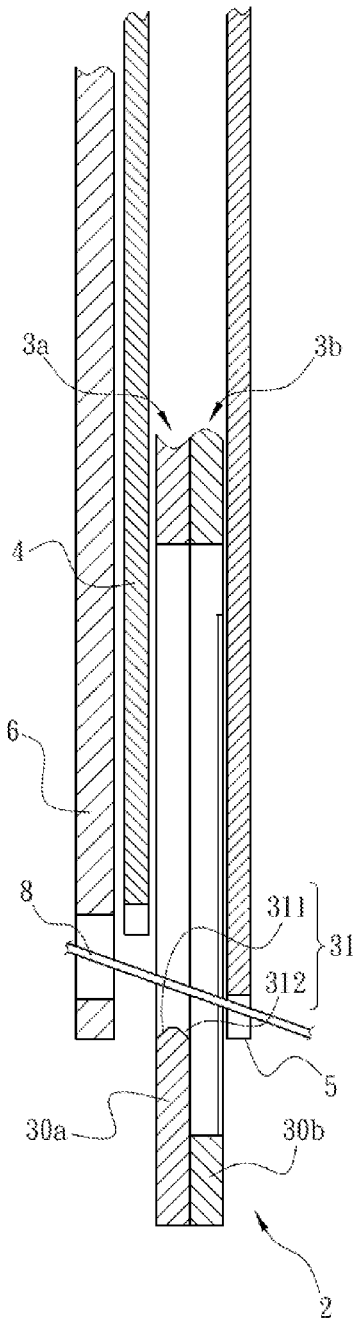
Figure 9:
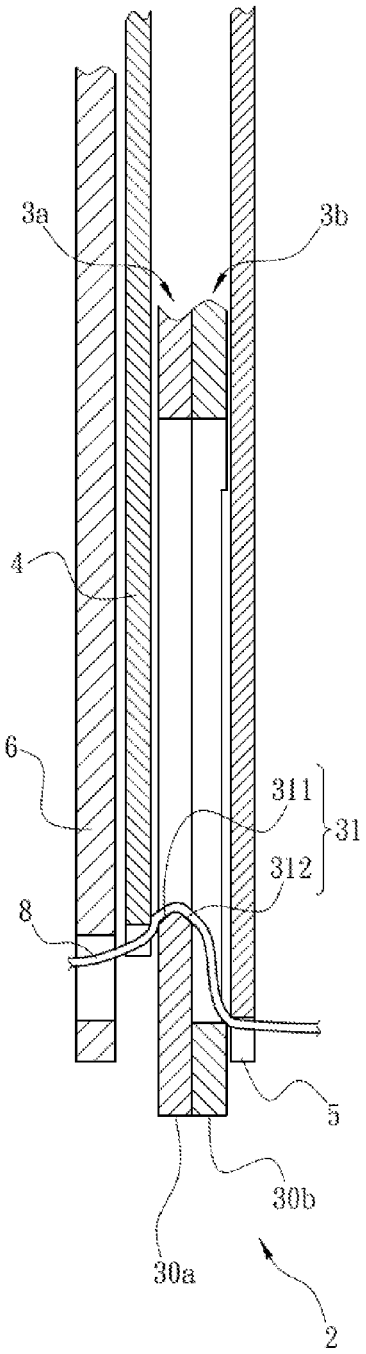
Figure 10:
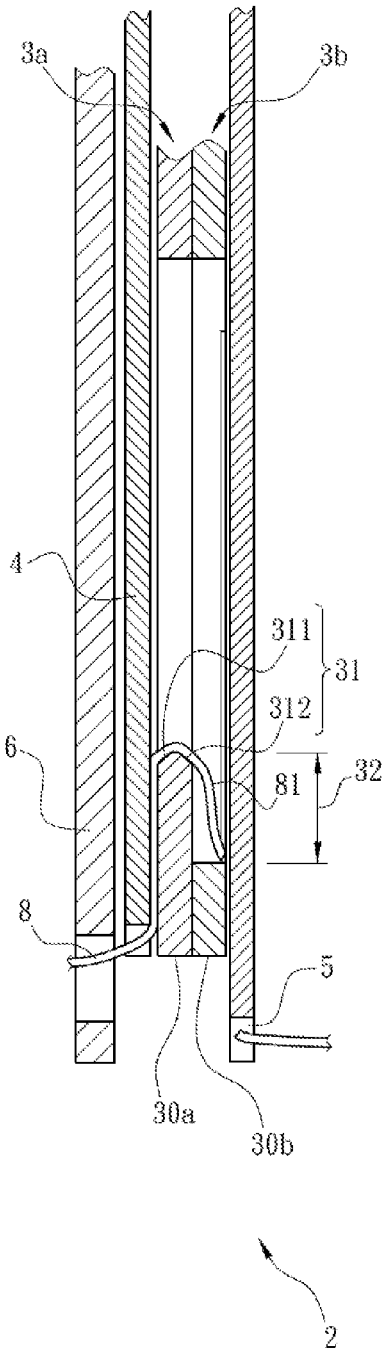

Please refer to FIGS. 5 through 10 for operation conditions of the yarn clipping and cutting structure of the invention. When the second yarn picking portion 30*b* of the second yarn clipping and cutting drive blade 3*b* has finished yarn cutting operation as shown in FIG. 5, the first yarn picking portion 30*a* of the yarn picking and cutting blade 3*a* and the yarn clipping blade 4 tightly clip the colored yarn 8, and the colored yarn 8 also forms a yarn clipping safety buffer section 81 at the spaced section 32 to avoid the colored yarn 8 from escaping the yarn clipping blade 4. When the yarn feeding blade 6 is moved and the colored yarn 8 is stretched again, the colored yarn 8 between the first yarn picking portion 30*a* and the yarn clipping blade 4 does not drop before the first yarn clipping and cutting drive blade 3*a* and the second yarn clipping and cutting drive blade 3*b* are extended outwards synchronously (referring to FIG. 6). When the first yarn clipping and cutting drive blade 3*a* and the second yarn clipping and cutting drive blade 3*b* are extended outwards synchronously the colored yarn 8 escapes between the first yarn picking portion 30*a* and the yarn clipping blade 4 (referring to FIG. 7) until the first yarn clipping and cutting drive blade 3*a* and the second yarn clipping and cutting drive blade 3*b* are fully extended to perform yarn picking operation again to pick the colored yarn 8 (referring to FIG. 8); after the first yarn clipping and cutting drive blade 3*a* and the second yarn clipping and cutting drive blade 3*b* have picked the yarn and retracted and proceed the yarn clipping and cutting operation, the colored yarn 8 at the directing section 31 first is in contact with the yarn clipping blade 4, and the first yarn picking portion 30*a* and the yarn clipping blade 4 start yarn clipping operation (referring to FIG. 9); while the first yarn picking portion 30*a* continues the yarn clipping operation the colored yarn 8 is interposed between the yarn clipping blade 4 and the first yarn picking portion 30*a* on a secure yarn clipping movement; next, yarn cutting operation takes place on the colored yarn 8 after the second yarn picking portion 30*b* is in contact with the yarn cutting blade 5 until the colored yarn 8 is fully cut off and the colored yarn 8 is fully clipped by the yarn clipping blade 4 and the first yarn picking portion 30*a* (referring to FIG. 10). It is to be noted that while the first yarn clipping and cutting drive blade 3*a* and the second yarn clipping and cutting drive blade 3*b* perform the yarn clipping and cutting process previously discussed the spaced section 32 forms the yarn clipping safety buffer section 81 which can prevent the yarn from escaping the yarn clipping blade 4 and dropping while the striping apparatus 1 is in high speed operation. In addition, the first directing sloped surface 311 is formed between the directing section 31 and the yarn clipping blade 4, the first directing sloped surface 311 with the side corner cut off can prevent the colored yarn 7 from being ruptured by an acute angle during the yarn clipping operation. Furthermore, the technique provided by the invention performs yarn cutting operation via the second yarn picking portion 30*b* and the yarn cutting blade 5 after the colored yarn 8 has been clipped, hence a fully yarn clipping effect can be accomplished while yarn cutting is performed merely on a single side. As a result, generation of yarn debris can be avoided and quality of knitting fabrics can be improved. Moreover, the striping apparatus 1 of the invention can maintain the original thickness of the yarn clipping and cutting structures 2, therefore the striping apparatus 1 can be installed on an existing circular knitting machine to form a desired match with the circular knitting machine which includes a greater number of yarn feeding ports.

Figure 11:
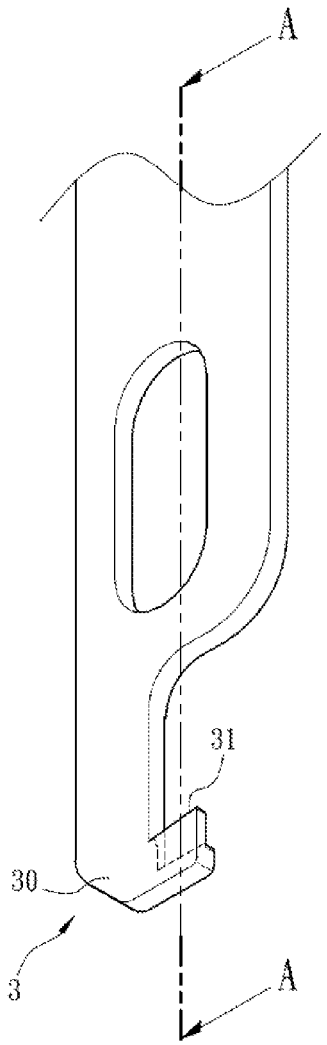
FIG. 11 is a fragmentary enlarged view of another embodiment of the yarn clipping and cutting drive blade of the invention according to FIG. 1.
Figure 12:
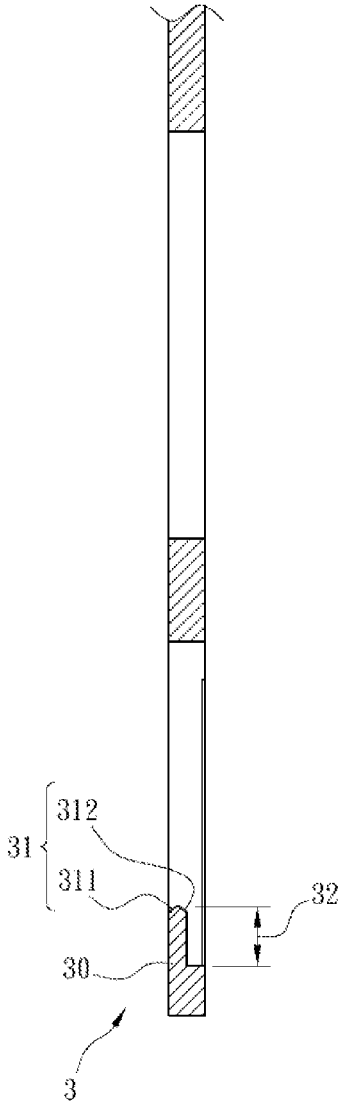
FIG. 12 is a cross sectional view taken on line A-A in FIG. 11.
Figure 13:
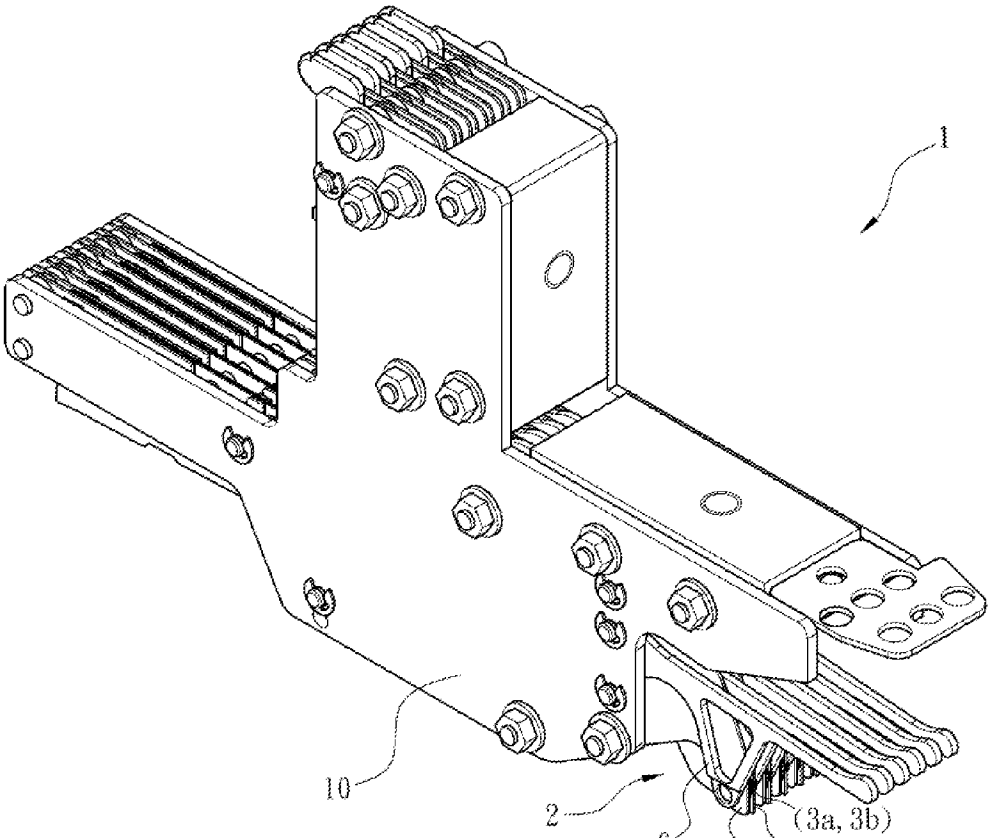
FIG. 13 is a perspective view of a second embodiment of the invention.
Figure 14:
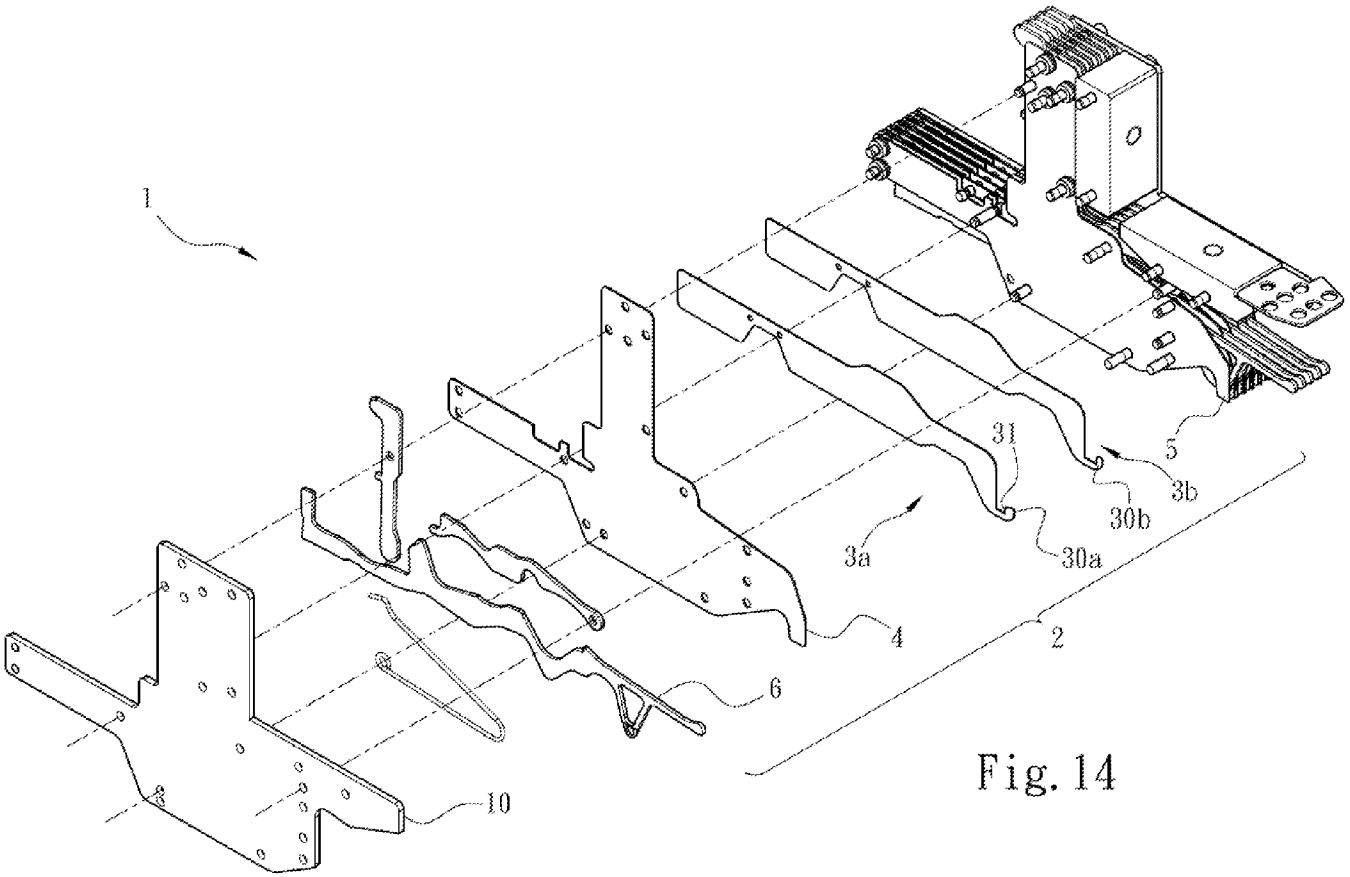
FIG. 14 is an exploded view according to FIG. 13.

Please refer to FIGS. 11 and 12 for another embodiment of the yarn clipping and cutting drive blade. Compared with the first yarn clipping and cutting drive blade 3*a* and the second yarn clipping and cutting drive blade 3*b* shown in FIGS. 1 through 10, the yarn clipping and cutting drive blade 3 in this embodiment differs by employing merely a single blade (integrated formed). Hence yarn clipping and cutting operation is performed synchronously by the yarn picking portion 30 of the yarn clipping and cutting drive blade 3. The invention also can be implemented as desired. Thus, the invention further provides a yarn clipping and cutting structure for a striping apparatus of a circular knitting machine. The striping apparatus 1 is installed on the circular knitting machine and driven by operation thereof. The striping apparatus 1 has two sides each has an outer cover plate 10 located thereon, and a plurality of yarn clipping and cutting structures 2 located between the two outer cover plates 10. The yarn clipping and cutting structures 2 can be interposed by an isolation blade 7 between them. Each yarn clipping and cutting structure 2 includes a yarn clipping and cutting drive blade 3 which has one side with a yarn feeding blade 6 located thereon, and a yarn clipping blade 4 located between the yarn clipping and cutting drive blades 3 and the yarn feeding blade 6 in contact with the yarn clipping and cutting drive blade 3. The yarn clipping and cutting drive blade 3 has another side with a yarn cutting blade 5 located thereon in contact with the yarn clipping and cutting drive blade 3. The yarn clipping and cutting drive blade 3 has an end edge formed a yarn picking portion 30 which has a directing section 31 movable against the yarn clipping blade 4 to perform yarn clipping operation. The directing section 31 has a first directing sloped surface 311 close to the yarn clipping blade 4 and a second directing sloped surface 312 close to a spaced section 32. The spaced section 32 is movable against the yarn cutting blade 5 and formed an elevation difference against the directing section 31.

Figure 15:
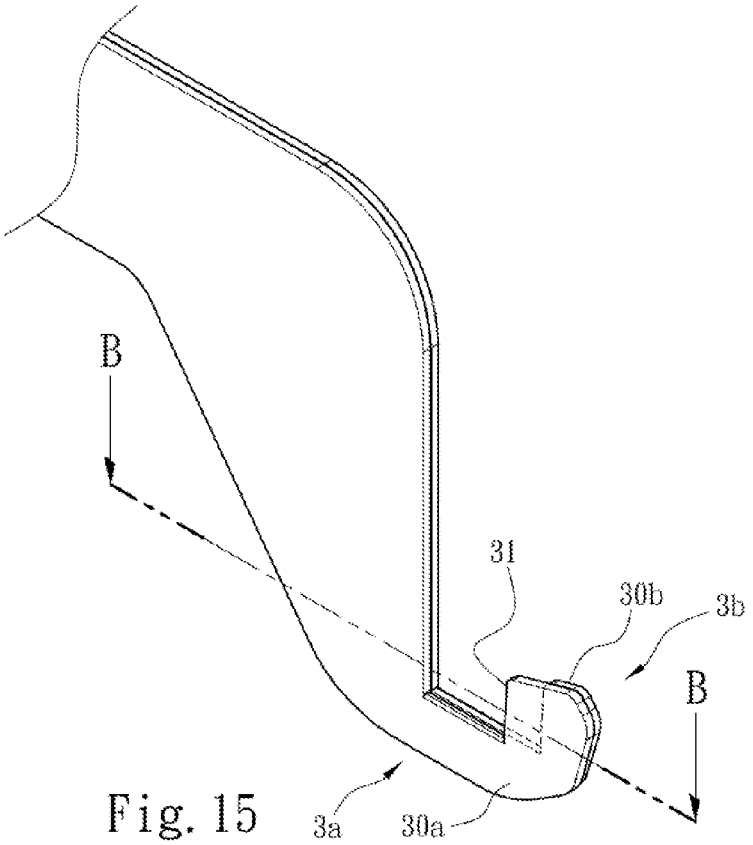
FIG. 15 is a fragmentary enlarged view of a yarn clipping and cutting drive blade according to FIG. 13.
Figure 16:
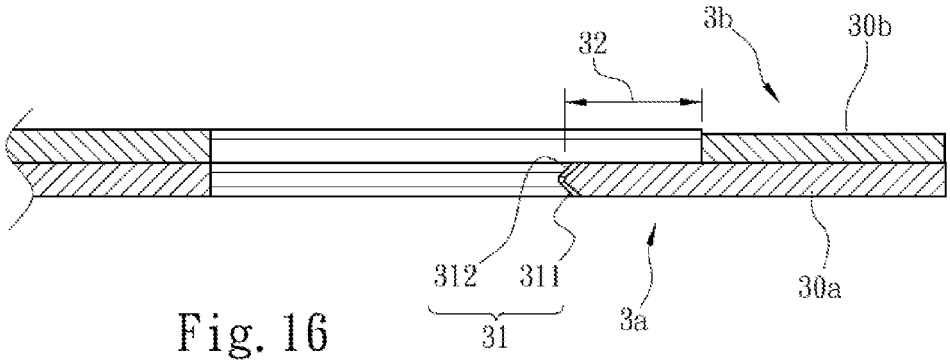
FIG. 16 is an enlarged sectional view taken on line B-B in FIG. 15.

Please refer to FIGS. 13 through 16 for operation conditions of the second embodiment of the yarn clipping and cutting structure of the invention. Compared with the first embodiment the second embodiment is a horizontal type. In addition, the second embodiment does not have the isolation blade 7 as the first embodiment does, but can be included as desired. It is to be noted that, as shown in FIGS. 15 and 16, the structural features and yarn clipping and cutting operation are same as that of the first yarn clipping and cutting drive blade 3*a* and the second yarn clipping and cutting drive blade 3*b* previously discussed in the first embodiment, thus also is implementable as desired.

While the preferred embodiments of the invention have been set forth for the purpose of disclosure, they are not the limitation of the invention, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A yarn clipping and cutting structure for a striping apparatus installed on a circular knitting machine, the striping apparatus being driven by operation of the circular knitting machine and included a plurality of yarn clipping and cutting structures, each yarn clipping and cutting structure comprising:

a first yarn clipping and cutting drive blade and a second yarn clipping and cutting drive blade that abut each other and are driven synchronously, the first yarn clipping and cutting drive blade being bordered by a yarn feeding blade at one side, the first yarn clipping and cutting drive blade and the yarn feeding blade being interposed by a yarn clipping blade in contact with the first yarn clipping and cutting drive blade, the first yarn clipping and cutting drive blade having a first end edge formed a first yarn picking portion which includes a directing section movable against the yarn clipping blade to perform yarn clipping operation; the second yarn clipping and cutting drive blade being in contact with a yarn cutting blade at another side opposing the yarn clipping blade, the second yarn clipping and cutting drive blade including a second end edge formed a second yarn picking portion which includes a spaced section movable against the yarn cutting blade to perform the yarn clipping operation and form an elevation difference against the directing section.

2. The yarn clipping and cutting structure of claim 1, wherein the directing section includes a first directing sloped surface proximate the yarn clipping blade.

3. The yarn clipping and cutting structure of claim 2, wherein the directing section includes a second directing sloped surface proximate the spaced section.

4. The yarn clipping and cutting structure of claim 1 further including an isolation blade interposed therebetween.

5. The yarn clipping and cutting structure of claim 2 further including an isolation blade interposed therebetween.

6. The yarn clipping and cutting structure of claim 3 further including an isolation blade interposed therebetween.

7. A yarn clipping and cutting structure for a striping apparatus installed on a circular knitting machine, the striping apparatus being driven by operation of the circular knitting machine and included a plurality of yarn clipping and cutting structures, each yarn clipping and cutting structure comprising:

a yarn clipping and cutting drive blade bordered by a yarn feeding blade at one side, the yarn clipping and cutting drive blade and the yarn feeding blade being interposed by a yarn clipping blade in contact with the yarn clipping and cutting drive blade, the yarn clipping and cutting drive blade being in contact with a yarn cutting blade at another side opposing the yarn clipping blade, the yarn clipping and cutting drive blade including an end edge formed a yarn picking portion which includes a directing section movable against the yarn clipping blade to perform yarn clipping operation and a spaced section movable against the yarn cutting blade to perform the yarn clipping operation and form an elevation difference against the directing section.

8. The yarn clipping and cutting structure of claim 7, wherein the directing section includes a first directing sloped surface proximate the yarn clipping blade.

9. The yarn clipping and cutting structure of claim 8, wherein the directing section includes a second directing sloped surface proximate the spaced section.

10. The yarn clipping and cutting structure of claim 7 further including an isolation blade interposed therebetween.

11. The yarn clipping and cutting structure of claim 8 further including an isolation blade interposed therebetween.

12. The yarn clipping and cutting structure of claim 9 further including an isolation blade interposed therebetween.

* * * * *